United States Patent [19]

Shiba et al.

[11] 4,086,094

[45] Apr. 25, 1978

[54] PHOTOGRAPHIC COUPLERS WITH N-HETEROCYCLIC DEVELOPMENT INHIBITING COUPLING-OFF GROUP

[75] Inventors: Keisuke Shiba; Takeshi Hirose; Kozo Inouye; Akio Okumura, all of Minami-ashigara, Japan

[73] Assignee: Fuji Photo Film Co., Ltd., Minami-ashigara, Japan

[21] Appl. No.: 588,556

[22] Filed: Jun. 19, 1975

[30] Foreign Application Priority Data

Jun. 20, 1974 Japan ..... 49-70669

[51] Int. Cl.[2] ..... G03C 1/40; G03C 7/00; G03C 5/54; G03C 1/48

[52] U.S. Cl. ..... 96/100 R; 96/3; 96/29 D; 96/56.2; 96/74; 96/76 R; 96/77; 96/95

[58] Field of Search ..... 96/3, 29 D, 77, 100, 96/74, 76 R, 95, 56.2, 66.3

[56] References Cited

U.S. PATENT DOCUMENTS

| | | | |
|---|---|---|---|
| 3,148,062 | 9/1964 | Whitmore et al. | 96/100 |
| 3,227,551 | 1/1966 | Barr et al. | 96/3 |
| 3,277,554 | 1/1966 | Barr et al. | 96/3 |
| 3,620,747 | 11/1971 | Marchant | 96/100 |
| 3,733,201 | 5/1973 | Barr | 96/100 |
| 3,770,436 | 11/1973 | Fujiwhara et al. | 96/100 |
| 3,900,322 | 8/1972 | Oishi et al. | 96/3 |
| 3,930,866 | 1/1976 | Oishi et al. | 96/100 |

OTHER PUBLICATIONS

"Yellow Forming Color Couplers" Research Disclosure #13013 2/1975.

*Primary Examiner*—Edward C. Kimlin
*Assistant Examiner*—Richard L. Schilling
*Attorney, Agent, or Firm*—Sughrue, Rothwell, Mion, Zinn and Macpeak

[57] ABSTRACT

A light-sensitive silver halide photographic material comprising a support having thereon at least one hydrophilic colloid layer which contains a color-forming coupler having a nitrogen-containing residue releasable on reaction of the coupler with an oxidation product of a color developing agent and which contains a thiocarbonyl group (S=C<), a selenocarbonyl group (Se=C<) or a telluriumcarbonyl group (Te=C<), the nitrogen atom of the nitrogen-containing residue being attached to the carbon atom in the coupling position of the coupler.

6 Claims, 2 Drawing Figures

FIG.1
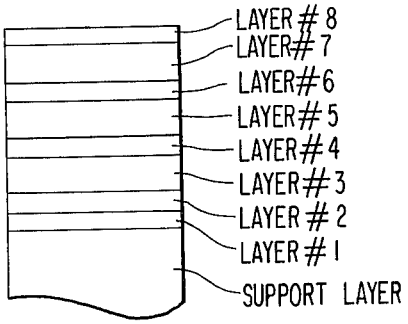
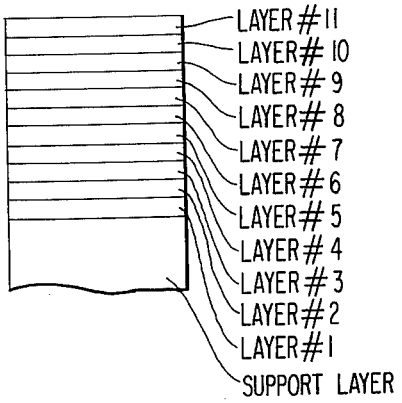
FIG.2

PHOTOGRAPHIC COUPLERS WITH N-HETEROCYCLIC DEVELOPMENT INHIBITING COUPLING-OFF GROUP

BACKGROUND OF THE INVENTION

1. Field of the Invention

The present invention relates to a photographic light-sensitive material capable of forming images having improved granularity and sharpness, and more particularly, it relates to a color photographic light-sensitive material capable of forming color images having improved granularity, sharpness and color-reproducing properties, which contains a color-forming coupler releasing a development inhibitor when reacted with an oxidation product of color developing agent and of which the storability is improved.

2. Description of the Prior Art

Recently, increasingly the tendency has been to require color photographic light-sensitive materials in which more information can be recorded per unit area.

Since the availability of silver as a raw material has been gradually reduced, it is desired to decrease the amount of silver halide to be incorporated in photographic light-sensitive materials and to form images on smaller areas of photographic light-sensitive materials. However, in order to produce photographic light-sensitive materials with these characteristics, the granularity, sharpness and color separation of images formed by the materials must be improved further.

Further, it is desired for the storability of color photographic light-sensitive materials to be improved because they are employed for various purposes and stored for long periods of time under various conditions.

Hitherto, the following techniques have been proposed to meet the above requirements. One technique is a method employing a so-called development-inhibitor releasing coupler (DIR coupler). A DIR coupler is a coupler capable of forming a dye and simultaneously releasing a development inhibitor by an oxidation coupling reaction with a color developing agent as disclosed in C. R. Barr, J. R. Thirtle and P. W. Vittum, *Photographic Science and Engineering,* Vol. 13, pages 74 to 80, and pages 214 to 217 (1969), and U.S. Pat. No. 3,227,554.

Typical examples of DIR couplers are monothio-type couplers having a coupling-off group in which a sulfur atom, a selenium atom or a tellurium atom is bonded to the carbon atom at the coupling position of the couplers (for example, as disclosed in U.S. Pat. Nos. 3,227,554 and 3,733,201, German Patent Application (OLS) No. 2,247,496, etc.), and imino-type couplers having a coupling-off group in which a nitrogen atom is bonded to the carbon atom at the coupling position of the couplers (e.g., as disclosed in U.S. Pat. Ser. No. 454,525, filed Mar. 25, 1974 and now U.S. Pat. No. 3,933,500) (interlayer color correction (I.C.C.) couplers)). A monothio-type coupler is generally advantageous for improving granularity and edge effects, but provides a development inhibiting effect in the light-sensitive emulsion layer containing the coupler in preference to an inter-image effect. In other words, the image sharpness can be improved using the coupler due to the granularity and edge effects generated by the coupler but this coupler reduces the gradation (gamma) of the light-sensitive layer in which the coupler is contained and reduces the maximum color density ($D_{max}$). This coupler also deteriorates the storability of light-sensitive materials. An imino-type coupler provides a development inhibiting effect between light-sensitive emulsion layers (e.g., an inter-image effect or a color correction effect) which is more marked than that observed in the light-sensitive emulsion layer in which the coupler is contained. This coupler also possesses the comparatively excellent properties of a two equivalent coupler and it hardly reduces gradation and $D_{max}$. However, an improvement of image granularity can not be expected in general on using an imino-type coupler.

Another technique is a method employing a colored coupler having an auto-masking function as disclosed in U.S. Pat. Nos. 2,449,966, 2,455,170, 2,600,788, 2,428,054, 3,148,062 and 2,983,608, and British Pat. No. 1,044,778. However, since the unexposed portions of photographic materials are always colored by a colored coupler, this coupler can not be employed in positive color photographic materials. Further, fog tends to occur due to the product which is produced where an arylazo group of the colored coupler is released and the granularity is deteriorated by fog.

Other techniques are known, for example, a method employing an inter-image effect accelerating agent as disclosed in U.S. Defensive Publication Nos. T909,022 and T909,023, a method employing an intermediate layer containing a direct positive emulsion or an internally fogged emulsion or a method employing a Luckey effect, but the results thereof are not necessarily sufficient. Further, a method is known in which the iodine content in the light-sensitive silver halide emulsions, the habit of the silver halide crystals, the developing rate, the components of the developing solutions or the developing conditions are controlled as disclosed in Japanese Patent Application No. 33,238/73, but the results obtained are not sufficient.

SUMMARY OF THE INVENTION

An object of the invention is to provide a color photographic light-sensitive material having improved granularity, sharpness and color reproducing properties which does not have the above disadvantages. Particularly, an object of the invention is to provide a color photographic light-sensitive material having improved granularity, sharpness and a color correction effect, simultaneously by incorporating a novel two equivalent DIR coupler having the advantages of the above-described monothio-type coupler and imino-type coupler.

A further object of the invention is to provide a photographic light-sensitive material containing a two equivalent DIR coupler having a novel chemical structure.

An additional object of the invention is to provide a color photographic light-sensitive material containing a novel DIR coupler which does not deteriorate the storability of light-sensitive materials as occurs with a monothio-type coupler.

An even further object of the invention is to provide a color photographic light-sensitive material containing a novel DIR coupler having improved properties whose light-fastness of the color images is not deteriorated even if a conventional two or four equivalent coupler is used together with a monothio-type coupler.

The above objects of the invention are attained with a light-sensitive silver halide photographic material comprising a support having thereon at least one hydrophilic colloid layer which contains a color-forming coupler having a nitrogen-containing residue which can be released from the coupler when the coupler reacts with an oxidation product of a color developing agent and which contains a thiocarbonyl group (S=C<), a selenocarbonyl group (Se=C<) or a telluriumcarbonyl group (Te=C<), and in which the nitrogen atom of the nitrogen-containing residue is attached to the carbon atom in the coupling position of the coupler.

BRIEF DESCRIPTION OF THE DRAWINGS

FIGS. 1 and 2 are illustrative cross-sectional views showing the constitution of the layers of light-sensitive photographic materials of the invention.

DETAILED DESCRIPTION OF THE INVENTION

As the nitrogen-containing residue of the coupler, a nitrogen-containing heterocyclic ring residue is preferred. Examples of couplers which can be used in the invention are the compounds represented by the following formula (I)

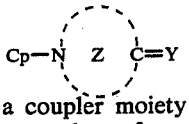

(I)

wherein Cp is a coupler moiety capable of coupling with an oxidation product of a color developing agent (e.g., an aromatic primary amino compound, particularly p-phenylenediamine derivatives and p-aminophenol derivatives); Y is a group which can be converted into a functional group forming a silver salt after the nitrogen-containing moiety is released (particularly, Y is a sulfur atom, a selenium atom or a tellurium atom); and Z is a nitrogen-containing moiety released on coupling with the oxidation product of the color developing agent and a nitrogen atom of which is bonded to the coupling position of the Cp moiety. The Z moiety has a chemical structure in which the compound represented by the formula (I) can have a tautomer as shown below when the Z moiety is released by color development.

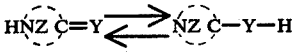

The Z moiety is preferably a heterocyclic group, and examples of the Z moiety can be selected from those disclosed in, for example, L. P. Clerc, *Chime Photographique* 2nd Edition Publications Photo-Cinema Paul Montel Paris (1957), particularly Section XXI and Part 4, and in C. E. K. Mees, *The Theory of the Photographic Process,* 2nd Edition MacMillan & Co., New York (1954).

Examples of

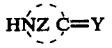

compounds include 2-thioxobenzoxazoline derivatives, 2-thioxobenzothiazoline derivatives, 2-thioxonaphthothiazoline derivatives, 2 thioxo-imidazoline derivatives, thiourazole derivatives, 5-thioxotetrazoline derivatives, thioxodihydroquinazoline derivatives, 5-thioxo-triazoline derivatives, 5-oxo-2-thioxo-imidazolidine derivatives, 5-thioxo-oxadiazoline derivatives, 5-selenoxo-tetrazoline derivatives, 5-telluroxotetrazoline derivatives, etc.

The examples of Cp residues can be selected from residues of couplers employed for color photographic light-sensitive materials, for example, as disclosed in U.S. Pat. Nos. 3,632,345 and 3,622,328, German Patent Application (OLS) Nos. 2,019,430 and 2,032,711, etc. Typical examples of Cp-H compounds include 2-acylaminophenol type cyan couplers, 2-carbamoylnaphthol type cyan couplers, 2-carbamoylnaphthol type cyan couplers, acylacetonitrile type magenta couplers, acylacetanilide type yellow couplers (e.g., pivaloylacetanilide couplers, aroylacetanilide couplers, etc.), 5-pyrazolone type magenta couplers, cyanoacetylcumarone type magenta couplers, indazolone type magenta couplers, pyrazolonebenzimidazole type magenta couplers, etc.

The characteristic properties of the couplers employed in the invention will be illustrated by reference to the following coupler, but the couplers of the invention should not be construed as being limited thereto.

COUPLER (1)

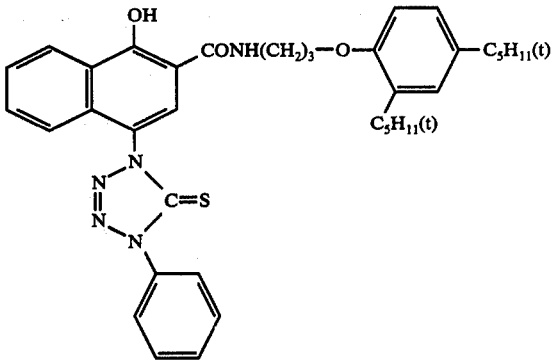

Coupler (1) forms a cyan color dye in high yield on coupling with a quinonediimine of p-amino-N-ethyl-N-(beta-methylsulfonylamidoethyl) m-toluidine sesquisulfate monohydrate as a color developing agent, and simultaneously, 1-phenyl-5-thioxotetrazole is quantitatively released. Coupler (1) is photographically inert to silver halide grains. The group released by the coupling reaction of the oxidation product of color developing agent is strongly bonded to the silver halide to form a silver salt.

The group released of Coupler (1), which corresponds to the Z moiety in the formula (I), is released by an oxidative coupling on color development and exhibits the following tautomerism.

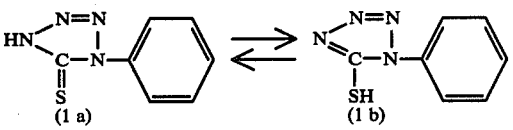

The tautomer (1b) can adsorb on silver halide grains by the formation of a mercapto silver salt.

Typical examples of couplers which can be employed in the invention, particularly couplers represented by the formula (I) are represented by the following formulae (II) to (IV),

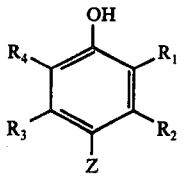

(II)

wherein $R_1$, $R_2$, $R_3$ and $R_4$ each represents the same substituents as in a phenol type cyan coupler and a naphthol type cyan coupler. For example, $R_1$ and $R_2$ each is an alkyl group having 1 to 18 carbon atoms (e.g., methyl, ethyl, propyl, iso-propyl, butyl, tert-butyl, n-octyl, n-hexadecyl, etc.), an aryl group (e.g., phenyl or naphthyl, etc.), a heterocyclic group (preferably containing one or more of an oxygen atom, a sulfur atom and a nitrogen atom as hetero atoms, e.g., 2-benzothiazolyl, 2-benzoxazolyl, 2-benzimidazolyl, 2-benzotriazolyl, etc.), a hydrogen atom, a halogen atom (e.g., chlorine, bromine, etc.), an amino group (e.g., an alkylamino group having up to 30 carbon atoms and preferably 1 to 20 carbon atoms, such as methylamino, diethylamino, tetradecylamino, etc.; arylamino groups, such as phenylamino, tolylamino, etc., heterocyclicamino groups, such as benzothiazolamino, etc.), a carbonamido or sulfonamido group (e.g., a carbonamido or sulfonamido group of the formulae —NH—CO—A and —NH—$SO_2$—A wherein A is an alkyl group such as an unsubstituted alkyl group having up to 30 carbon atoms and preferably 1 to 20 carbon atoms, and a substituted alkyl group such as a haloalkyl group or a polyhaloalkyl group such as a fluoroalkyl group or an aryloxyalkyl group wherein the alkyl moiety thereof preferably contains up to about 15 carbon atoms and the aryloxy moiety thereof includes a phenoxy group or a naphthoxy group, which can be additionally substituted with one or more of an alkyl group, an alkoxy group or a halogen atom, in which the alkyl or alkoxy moieties of these additional substituents can contain up to 30 carbon atoms and are exemplified by methyl, propyl, tert-butyl, sec-butyl, pentadecyl, methoxy and octadecyloxy, etc., an aryl group such as a phenyl group or a naphthyl group having one or more of an alkyl group, an alkoxy group, a halogen (such as chlorine), a cyano group, a nitro group, an alkylcarbonamido group, an alkylsulfonamido group, an arylcarbonamido group, an arylsulfonamido group, an alkylcarbamoyl group, an alkylsulfamoyl group, an arylcarbamoyl group, an arylsulfamoyl group, an alkoxycarbonyl group, an aryloxycarbonyl group, an imido group (such as succinimido), an aryloxy group and an ureido group as substituents thereon, with the alkyl moiety of the alkyl, alkoxy, alkylcarbonamido, alkylsulfonamido, alkylcarbamoyl, alkylsulfamoyl and alkoxycarbonyl groups each containing up to 30 carbon atoms and preferably 1 to 20 carbon atoms; and an heterocyclic group such as a 2-furyl group), a sulfamoyl or carbamoyl group (e.g., carbamoyl and sulfamoyl groups of the formulae —CONH—A and —$SO_2$NH—A wherein A is defined as above) or an alkoxy group (e.g., in which the alkyl moiety has up to 30 carbon atoms, preferably 1 to 20 carbon atoms e.g., alkyl moieties such as methyl, ethyl, propyl, iso-propyl, butyl, tert-butyl, n-octyl, n-octadecyl, etc.), and $R_3$ and $R_4$ each represents the same substituents as $R_1$ and $R_2$ or represents an atomic group necessary for completing a benzo group together therewith which can be substituted with an alkylthio group, a sulfo group and a sulfamoyl group. The Z moiety is a nitrogen-containing heterocyclic group which can be released and is the same as described in the formula (I).

A ballast group which renders the coupler non-diffusible can be bonded directly or through an imino bond, an ether bond, a thioether bond, a carbonamido bond, a sulfonamido bond, an ureido bond, an ester bond, an imido bond, a carbamoyl bond, a sulfamoyl bond, etc. to the molecule of the coupler represented by the formula (II)

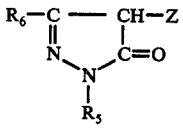

(III)

wherein $R_5$ and $R_6$ each represents the same substituents as in a pyrazolone coupler. For example, $R_5$ is an alkyl group (preferably, having 5 to 22 carbon atoms, e.g., methyl, ethyl, iso-propyl, tert-butyl, n-hexyl, dodecyl, etc., and which can be substituted with one or more substituents, e.g., a halogen atom (such as chlorine or bromine) a cyano group, an aryl group (such as phenyl or naphthyl), etc.), an aryl group (e.g., an unsubstituted aryl group such as phenyl or naphthyl or an aryl group substituted with one or more of an alkyl group, an alkoxy group, a halogen atom (such as chlorine), a cyano group, a nitro group, a sulfo group, a carboxy group, an alkylcarbonamido group, an alkylsulfonamido group, an arylcarbonamido group, an arylsulfonamido group, an alkylcarbamoyl group, an alkylsulfamoyl group, an arylcarbamoyl group, an arylsulfamoyl group, an alkoxycarbonyl group, an aryloxycarbonyl group, an aryloxy group, and a ureido group with the alkyl moiety containing up to 30 carbon atoms and preferably 1 to 20 carbon atoms) or a heterocyclic group (e.g., pyridinyl, acrydinyl, thiazolyl, benzothiazolyl, pyperidinyl, quinolinyl, thiadiazolyl and triazolyl, etc.), and $R_6$ is an alkyl group having 1 to 18 carbon atoms (e.g., methyl, ethyl, heptyl, n-heptadecyl, etc.), an amino group (particularly, a mono or disubstituted amino group substituted with an alkyl group, an aryl group, an acyl group, etc. (e.g., an alkylamino group having up to 30 carbon atoms and preferably 1 to 20 carbon atoms, such as methylamino, diethylamino, pyrrolidino, tetradecylamino, etc., an arylamino group, such as phenylamino having one or more of an alkyl group, an alkoxy group, a halogen atom (such as chlorine), a cyano group, a nitro group, an alkylcarbonamide group, an alkylsulfonamido group, an arylcarbonamido group, an arylsulfonamido group, an alkylcarbamoyl group, an alkylsulfamoyl group, an arylcarbamoyl group, an arylsulfamoyl group, an alkoxycarbonyl group, an aryloxycarbonyl group, an imido group (such as succinimido), an aryloxy group and a ureido group as a substituent group thereon, in which the alkyl moiety of the alkyl, alkoxy, alkylcarbonamido, alkylsulfonamido, alkylcarbamoyl, alkylsulfamoyl or alkoxycarbonyl group can contain up to 30 carbon atoms and preferably 1 to 20 carbon atoms, etc., and an acylamino group (such as acetamido, benzoylamino, 3-(2,4-di-tert-amylphenoxyacetamido)benzoylamino and ureido, etc.)), an alkoxycarbonyl group (e.g., in which the alkyl moiety of the alkoxy moiety contains up to 30 carbon atoms, preferably 1 to 22 carbon atoms, e.g., alkyl moieties such as methyl, n-hexyl, iso-propyl, tetradecyl, etc.), an aryl group, a heterocyclic group or an alkoxy group. The Z moiety is a nitrogen-containing heterocyclic group which can be released on coupling and is same as described in the formula (I). The coupler of the formula (III) has a non-diffusing ballast group as described above in the molecule.

$$R_7-\underset{\underset{Z}{|}}{COCH}-X \qquad \text{(IV)}$$

wherein $R_7$ is an aliphatic hydrocarbon group (e.g., having up to 30 carbon atoms, preferably 1 to 20 carbon atoms and including a primary, secondary or tertiary alkyl group (e.g., methyl, tertbutyl, n-heptadecyl, etc.), or a substituted alkyl group thereof substituted with substituents such as an alkoxy group (e.g., methoxy, hexyloxy, etc.) an alkylthio group (e.g., ethylthio, octylthio, etc.), etc.), e.g., 1,1-dimethyl-1-methoxyphenoxymethyl, 1,1-dimethyl-1-phenylthio, etc.) or an aryl group (e.g., phenyl, 2-alkoxyphenyl, 3-octadecylphenyl, etc.), X includes a cyano group and a carbamoyl group, and Z is a nitrogen-containing heterocyclic group which can be released on coupling and is the same as described in the formula (I). The coupler of the formula (IV) has a non-diffusing ballast group as described above in the molecule.

The non-diffusing ballast group contained in the couplers of the formulae (II), (III) and (IV) is a group containing a hydrophobic moiety of 8 to 32 carbon atoms and is connected directly or through an imino bond, an ether bond, a thioether bond, a carbonamido bond, a sulfonamido bond, an ureido bond, an ester bond, an imido bond, a carbamoyl bond, a sulfamoyl bond, etc. to the skeleton structure of the couplers. Couplers having such a ballast group are disclosed in Japanese Patent Application Nos. 68,892/73 and 75,126/73.

Suitable examples of ballast groups are illustrated specifically below:

(I) Alkyl groups and alkenyl groups, such as $-CH_2-CH(C_2H_5)_2$, $-C_{12}H_{25}$, $-C_{16}H_{33}$, and $-C_{17}H_{33}$ (II) Alkoxyalkyl groups, such as $-(CH_2)_3-O-(CH_2)_7CH_3$, and $$-(CH_2)_3OCH_2-\underset{\underset{C_2H_5}{|}}{CH}-(CH_2)_8-CH_3$$

as described in Japanese Patent Publication No. 27,563/64.

(III) Alkylaryl groups such as

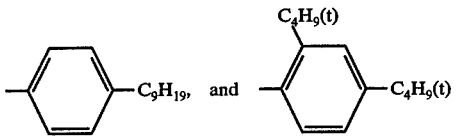

(IV) Alkylaryloxyalkyl groups such as

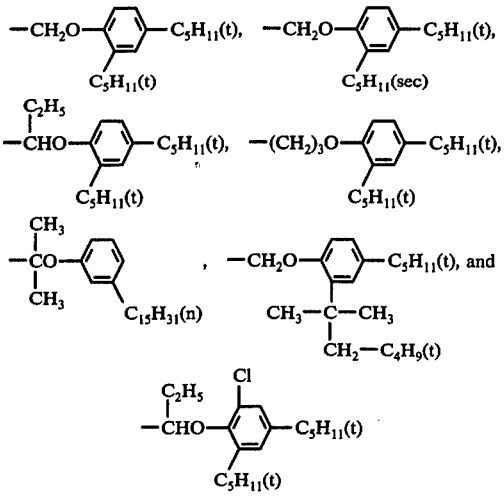

(V) Acylamidoalkyl groups such as

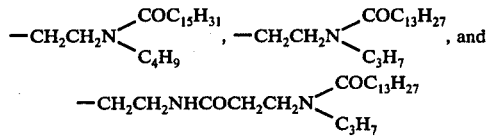

as described in U.S. Pat. Nos. 3,337,344 and 3,418,129.

(VI) Alkoxyaryl groups and aryloxyaryl groups such as

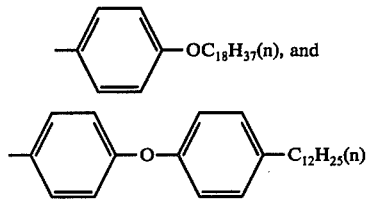

(VII) Residues having both an alkyl or alkenyl long-chain aliphatic group and a carboxy or sulfo water-solubilizing group together such as $$-\underset{\underset{CH_2COOH}{|}}{CH}-CH{=}CH-C_{16}H_{33}, \text{ and } -\underset{\underset{SO_3H}{|}}{CH}-C_{16}H_{33}$$

(VIII) Alkyl groups substituted with an ester group such as $$-\underset{\underset{COOC_2H_5}{|}}{CH}-C_{16}H_{33}(n), \text{ and } -CH_2-CH_2-COOC_{12}H_{25}(n)$$

(IX) Alkyl groups substituted with an aryl group or a heterocyclic group such as

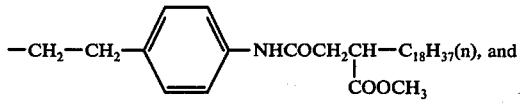

-continued

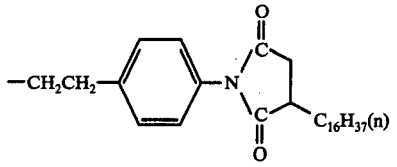

(X) Aryl groups substituted with an aryloxyalkoxycarbonyl group such as

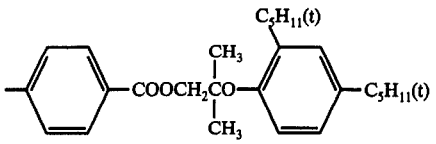

More preferred examples of couplers which can be employed in the invention are described below, but the coupler of the invention is not to be construed as being limited to these examples.

COUPLER (1)

1-Hydroxy-4-(4-phenyl-5-thioxotetrazolin-1-yl)-N-[γ-(2,4-di-tert-amylphenoxy)propyl]-2-naphthamide

COUPLER (2)

3-Tetradecaneamido-4-(1-benzyl-5-thioxo-3-methyl-1,2,4-triazolin-4-yl)phenol

COUPLER (3)

1-Hydroxy-4-(4-phenyl-5-thioxotetrazolin-1-yl)-2-(2'-tetradecyloxy)naphthanilide

COUPLER (4)

1-Hydroxy-4-(3-allyl-5-oxo-2-thioxoimidazolidin-1-yl)-N-[γ-(2,4-di-tert-amylphenoxy)propyl]-2-naphthamide

COUPLER (5)

1-Hydroxy-4-(3-benzyl-5-oxo-2-thioxoimidazolidin-1-yl)-2-(2'-chloro-5'-hexadecyloxycarbonyl)naphthanilide

COUPLER (6)

2-Heptafluorobutyramido-4-(4-phenyl-5-thioxotetrazolin-1-yl)-5-[α-(2,4-di-tert-amylphenoxy)-butyramido]phenol

COUPLER (7)

1-Hydroxy-4-(1,3-diphenyl-5-thioxo-1,2,4-triazolin-4-yl)-N-[δ-(2,4-di-tert-amylphenoxy)butyl]-2-naphthamide

COUPLER (8)

1-Hydroxy-4-(3-phenyl-5-thioxo-1,2,4-oxadiazolin-4-yl)-4-[γ-(2,4-di-tert-amylphenoxy)propyl]-2-naphthamide

COUPLER (9)

5-Methyl-4-(3-oxo-5-thioxo-1,2,4-triazolin-4-yl)-2-[α-(2,4-di-tert-amylphenoxy)butyramido]phenol

COUPLER (10)

2-n-Butyramido-4-(1,2-diphenyl-3,5-di-thioxo-1,2,4-triazolidin-4-yl)-6-[α-(2,4-di-tert-amylphenoxy)-butyramido]phenol

COUPLER (11)

1-(2,4,6-Trichlorophenyl)-3-(2-chloro-5-tetradecanamidoanilino)-4-(4-phenyl-5-thioxotetrazolin-1-yl)-5-pyrazolone

COUPLER (12)

1-Hydroxy-4-(3-benzyl-4,4'-dimethyl-5-oxo-2-thioxoimidazolidin-1-yl)-N-[γ-(2,4-di-tert-amylphenoxy)-propyl]-2-naphthamide

COUPLER (13)

1-{4-[α-(2,4-Di-tert-amylphenoxy)butyramido]-phenyl}-3-dibutylamino-4-(4-phenyl-5-thioxotetrazolin-1-yl)-5-pyrazolone

COUPLER (14)

1-(2,4,6-Trichlorophenyl)-3-[3-(2,4-di-tert-amylphenoxyacetamido)benzamido]-4-(4-phenyl-5-thioxotetrazolin-1-yl)-5-pyrazolone

COUPLER (15)

α-Pivaloyl-α-(4-phenyl-5-thioxotetrazolin-1-yl)-2-chloro-5-[α-(2,4-di-tert-amylphenoxy)butyramido]-acetanilide

COUPLER (16)

α-(4-Methoxybenzoyl)-α-(4-phenyl-5-thioxotetrazolin-1-yl)-2-methoxy-5-(tetradecyloxycarbonyl)acetanilide

COUPLER (17)

1-Hydroxy-4-(3-oxo-5-thioxo-1,2,4-triazolin-4-yl)-4-n-dodecyl-2-naphthamide

COUPLER (18)

1-{4-[α-(2,4-Di-tert-amylphenoxy)butyramido]-phenyl}-3-pyrrolidino-4-(4-phenyl-5-thioxotetrazolin-1-yl)-5-pyrazolone

COUPLER (19)

1-Hydroxy-4-(2-methylthio-5-thioxo-1,3,4-thiadiazolin-4-yl)-2-(2'-chloro-5'-hexadecyloxycarbonyl)naphthanilide

COUPLER (20)

1-Hydroxy-4-(1-phenyl-5-thioxotetrazolin-2-yl)-2'-chloro-5'-hexadecyloxycarbonyl-2-naphthanilide Typical examples of methods for preparing the couplers employed in the invention are shown below. Unless otherwise indicated herein, all parts, percents, ratios and the like are by weight.

SYNTHESIS EXAMPLE 1

(Coupler (4))

(a) In 1 liter of acetic acid, 100 g of 1-hydroxy-N-[γ-(2,4-di-tert-amylphenoxy)propyl]-2-naphthamide was dissolved and nitrated using 23 g of a 60% nitric acid aqueous solution at 15° to 18° C. After the completion of the reaction, 1 liter of methanol was added to the reaction mixture, and the precipitated crystals were filtered and recrystallized from 2 liters of a mixture of ethyl acetate and methanol (2:1 by volume) to provide 70 g of 1-hydroxy-4-nitro-N-[γ-(2,4-di-tert-amylphenoxy)propyl]-2-naphthamide having a melting point of 209° to 210° C.

(b) In 500 ml of a 90% acetic acid aqueous solution, 50 g of 1-hydroxy-4-nitro-N-[γ-(2,4-di-tert-amylphenoxy)propyl]-2-naphthamide was reduced with 50 g of iron as a reducing agent. The reaction mixture was added to water and then was extracted with ethyl acetate. After evaporating off the ethyl acetate, the crystals were recrystallized from ligroin to provide 40 g of 1-hydroxy-4-amino-N-[γ-2,4-di-tert-amylphenoxy)-propyl]-2-naphthamide having a melting point of 132° to 133° C.

(c) A mixture of 20.6 g of dicyclohexylcarbodiimide, 20 ml of pyridine and 40 ml of carbon disufide was cooled to −10° C and into the mixture, 100 ml of a pyridine solution containing 47.6 g of 1-hydroxy-4-amino-N-[γ-(2,4-di-tert-amylphenoxy)-propyl]-2-naphthamide was added under stirring. After the completion of the reaction, the solvent was evaporated off, 100 ml of ethyl acetate was added to the residue, and then the solution was filtered, followed by concentrating the filtrate. To the residue, 200 ml of acetonitrile was added and the precipitated crystals were recovered to obtain 42 g of 1-hydroxy-4-isothiocyanate-N-[γ-(2,4-di-tert-amylphenoxy)propyl]-2-naphthamide having a melting point of 91° to 94° C. This step of the reaction was carried out according to the method disclosed in J. C. Jockims Chem. Ber. vol. 101, page 1746 (1968).

(d) In 500 ml of ethyl acetate, 14 g of ethyl allylaminoacetate and 56 g of 1-hydroxy-4-isothiocyanate-N-[γ-(2,4-di-tert-amylphenoxy)propyl]-2-naphthamide were dissolved and refluxed under heating for 3 hours. After the reaction, the solvent was evaporated off and recrystallization of the crystals from ethanol was carried out to obtain 40 g of 1-hydroxy-4-(3-allyl-5-oxo-2-thioxoimidazolidin-1-yl)-N-[γ-(2,4-di-tert-amylphenoxy)-propyl]-2-naphthamide having a melting point of 204° to 205° C.

SYNTHESIS EXAMPLE 2

(Coupler (14))

(a) In 200 ml of acetic acid, 33 g of 1-(2,4,6-trichlorophenyl)-3-[3-(2,4-di-tert-amylphenoxyacetamido)benzamido]-5-pyrazolone was dissolved. 7.5 g of bromine was dropwise added to the solution with stirring. After the completion of the reaction, the reaction mixture was added to water, and the thus obtained crystals recovered by filtration and washed were recrystallized, after drying, from 150 ml of a mixture of ethyl acetate and ligroin (1:10 by volume) to obtain 26 g of 1-(2,4,6-trichlorophenyl-3-[3-(2,4-di-tert-amylphenoxyacetamido)-benzamido]-4-bromo-5-pyrazolone having a melting point of 139° to 141° C.

(b) According to the method disclosed in Pharmazle, 29 (2) page 90, a mercuric salt of 1-phenyl-5-mercaptotetrazole and 1-(2,4,6-trichlorophenyl)-3-[3-(2,4-di-tert-amylphenoxyacetamido)benzamido]-4-bromo-5-pyrazolone were reacted in dimethylformamide. The reaction mixture was poured into water, was extracted with ethyl acetate and washed. After evaporating off the ethyl acetate under reduced pressure, the remaining substance was recrystallized from ethanol to provide 1-(2,4,6-trichlorophenyl)-3-[3-(2,4-di-tert-amylphenoxyacetamido)benzamido]-4-(4-phenyl-5-thioxotetrazolin-1-yl)-5-pyrazolone having a melting point of 169° to 171° C.

The coupler of the invention includes Fischer type couplers having a water solublizing group such as a carboxyl group, a sulfo group or a hydroxy group, and hydrophobic couplers. The Fischer type couplers can be added to a gelatino silver halide emulsion or a hydrophilic colloid as an aqueous solution, and the hydrophobic couplers can be added to a gelatino silver halide emulsion or a hydrophilic colloid as a dispersion which is obtained by dispersing an organic solvent solution of a hydrophobic coupler or the hydrophobic coupler can be melted and dispersed in a hyrophilic colloid.

The coupler of the invention can be dispersed using any conventional method, for example, as disclosed in U.S. Patent Application Ser. No. 454,525, filed Mar. 25, 1974. Specific examples of methods include dispersing the couplers in a high boiling organic solvent such as dibutyl phthalate, tricresyl phosphate, a wax, a higher fatty acid or an ester thereof, a glycerol derivative, a citric acid derivative, etc., as disclosed in U.S. Pat. Nos. 2,304,939 and 2,322,027, and U.S. Patent Application Ser. No. 485,655, filed July 3, 1974, etc., dispersing the couplers in a low boiling organic solvent or a water-soluble organic solvent, if necessary, together with a high boiling organic solvent, as disclosed in U.S. Pat. Nos. 2,801,170, 2,801,171, 2,949,336, etc. and dispersing the couplers in another coupler having a low melting point (e.g., not higher than about 75° C) as disclosed in German Patent No. 1,143,707.

Suitable dispersing agents for dispersing the couplers of the invention include an anionic surface active agent such as an alkylbenzene sulfonate or Fischer type couplers or disclosed in U.S. Patent Application Ser. No. 501,107, filed Aug. 27, 1974 and U.S. Patent Application Ser. No. 514,712, filed Oct. 15, 1974, an amphoteric surface active agent such as N-tetradecyl-N,N-dipolyethylene-alpha-betaine or N-dodecyl-N,N-dimethyl-alpha-betaine, and a non-ionic surface active agent such as sorbitan monolaurate.

Specific examples of hydrophilic colloids which can be used are gelatin; gelatin derivatives such as lime-treated gelatin, enzyme-treated gelatin, desalted gelatin, phthalated gelatin, guanidilated gelatin, hydroxyethylated gelatin or grafted gelatin which is the reaction product of gelatin and a high molecular weight material obtained by bonding a functional group in the gelatin molecule (e.g., an amino group, an imino group, a hydroxyl group or a carboxyl group) to a molecular chain of the high molecular weight material; other hydrophilic polymers such as cellulose derivatives, polyvinyl alcohol or copolymers thereof, poly(N-vinyl pyrrolidone) or copolymers thereof, polyacrylic acid or copolymers thereof, polyacrylamide or derivatives thereof, or polystyrene or derivatives thereof; and mixtures thereof.

The silver halide emulsions used in the invention can contain silver halides such as silver chloride, silver bromide, silver iodide and mixtures thereof. The diameter of silver halide grains preferably is about 0.03 to 2 microns and silver halide grains can have various habits such as a (1 1 1) plane, a (1 0 0) plane or a (1 1 0) plane and can have a cubic, octahedral, dodecahedral, globular or plate-like crystal form.

These silver halide grains can be prepared by any conventional method, for example, a single-jet method, a double-jet method or a triple-jet method; a neutral method, an ammoniacal method, a partially-ammoniacal method or an acid method; a method of mixing a alkali metal halide solution into a silver nitrate solution or vice versa, or a conversion method.

The silver halide grains of the invention can be chemically sensitized with a gold sensitizer as disclosed in U.S. Pat. Nos. 2,399,083, 2,597,856 and 2,597,915, a reduction sensitization method as disclosed in U.S. Pat. Nos. 2,487,850 and 2,521,925, a sulfur sensitization method as disclosed in U.S. Pat. Nos. 1,623,499 and 2,410,689, and a sensitization method using metal ions other than silver or combination thereof as disclosed in U.S. Pat. Nos. 2,448,060, 2,566,245 and 2,566,263. Further, spectral sensitization methods employed in conventional color photographic materials can be applied to the silver halide emulsions of the invention.

The silver halide photographic emulsions can contain a stabilizer such as a 4-hydroxy-1,3,3*a*,7-tetraazaindene derivative or a mercapto compound having a sulfo group, an antifoggant such as a mercapto compound, a benzotriazole derivative or a hydroquinone derivative, a coating aid, a hardening agent, a wetting agent or a sensitizer such as an onium compound as disclosed in U.S. Pat. Nos. 2,271,623, 2,288,226 and 2,334,864, a polyalkylene oxide derivative as disclosed in U.S. Pat. Nos. 2,708,162, 2,531,832, 2,533,990, 3,210,191 and 3,158,484, 1-phenyl-3-pyrazolidone and derivatives thereof or 2-methylimidazole and derivatives thereof. To the silver halide emulsions can be further added an organic compound for accelerating the inter-image effect as disclosed in Japanese Patent Application No. 73,445/73, an anti-irradiation dye and a dye for improving safety to safe light.

The light-sensitive silver halide emulsion of the invention can be coated on a support such as a cellulose acetate film, a polyethylene terephthalate film, a polyethylene film, a polypropylene film, a glass plate, an acrylic resin plate, baryta paper, a synthetic resin-coated paper or synthetic paper. A suitable coating amount of the silver halide can range from about 0.1 to 100 g (as silver) per $m^2$, preferably 1 to 20 g (as silver) per $m^2$.

Two or more hydrophilic colloid layers can be coated on a support as photographic elements. A multilayer color light-sensitive material has at least three coated layers, that is, a blue-sensitive layer unit (BL) having a spectral sensitivity in the blue light region, a green-sensitive layer unit (GL) having a spectral sensitivity in the green light region and a red-sensitive layer unit (RL) having a spectral sensitivity in the red light region. Each layer unit can be a single layer or can comprise at least two sub-layers which have a different sensitivity or gradation (gamma) from each other. The constitution of each layer unit and sublayer can be varied in any order. An intermediate layer (ML), a filter layer (FL) which can be mordanted by an acid dye, a protective layer (PL), an antihalation layer (AHL) and an antistain layer preventing stain materials from leaching out into the developing solution as disclosed in U.S. Pat. No. 3,737,317 can be coated as other photographic elements.

The two equivalent DIR coupler of the invention is included in a particular layer together with another coupler in a certain ratio to effectively improve the image sharpness by the interimage effect thereof and granularity and gradation by an intra image effect. For example, the two equivalent DIR coupler can be used instead of an uncolored coupler for color-correction between layers as disclosed in U.S. Patent Application Ser. No. 467,539, filed May 6, 1974. The two equivalent DIR coupler of the invention can be used with other four or two equivalent couplers (e.g., colored couplers or non-color forming coupler) in an appropriate molar ratio of the DIR coupler, preferably 1 to 50 mol% of the DIR coupler to the total amount of couplers present. A suitable amount of silver halide ranges from about 0.1 to 200, preferably 0.2 to 100, mol/mol of the total couplers present. Suitable examples of conventional couplers which can be semployed are described in U.S. Pat. Nos. 1,108,028, 2,186,849, 2,206,142, 2,343,702, 2,367,531, 2,369,489, 2,423,730, 2,436,130, 2,474,293, 2,600,788, 2,689,793, 2,728,658, 2,742,832, 2,808,329, 2,998,314, 3,046,129, 3,062,653, 3,265,506, 3,311,476, 3,408,194, 3,419,390, 3,419,391, 3,458,315, 3,476,563, 3,516,831, 3,617,291, etc.

The two equivalent coupler can be used together with an anti-staining agent such as phenol derivatives (e.g., hydroquinone derivatives) or tinuvin compounds which are disclosed in Belgian Pat. No. 777,487, German Pat. No. 1,547,684, German Patent Application (OLS) No. 2,146,668, U.S. Pat. Nos. 2,336,327, 2,728,659, 2,835,579, 3,253,921, 3,432,300, 3,698,909, 3,764,337, 3,794,493, an anti-foggant and a fluorescent brightening agent. Further, it can be used in combination with the other couplers according to the method as disclosed in U.S. Patent Ser. No. 480,802 filed on June 19, 1974.

The color photographic light-sensitive materials of the present invention are, after exposure, subjected to a color processing to form dye images. This color processing includes basically a color development step, a bleaching step and a fixing step. Each step can be carried out individually or two or more steps can be combined into one step where a processing solution having these two or more functions is used. One example of such a combination is a blix solution. Also each step can be separated into two or more steps. For example, a process comprising a color development step, a first fixing step, and a blixing step can be used. The color processing can further include a pre-hardening step, a neutralization step, a first development (black & white development) step, a stabilizing step, a washing step, and the like, if desired. The temperature of processing can be varied depending on the photographic light-sensitive material, the color processing method, and the like. In general, a temperature above 18° C is used, although a temperature below 18° C can be used, if desired. A temperature range of 20° to 60° C, recently 30° to 60° C, is conventionally used. Each of these processing steps need not necessarily be conducted at the same temperature.

A color developer solution is an alkaline solution having a pH of more than about 8, preferably from 9 to 12, and containing, as a developing agent, a compound, whose oxidized product is capable of forming a colored compound when reacted with a color forming agent, i.e., a color coupler. The developing agent described above includes a compound capable of developing an exposed silver halide and having a primary amino group on an aromatic ring, and a precursor which forms such a compound. Preferred typical examples of these developing agents are, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diethylaniline, and the salts thereof (for example, the sulfates, the hydrochlorides, the sulfites, the p-toluene sulfonates, and the like). Other developing agents such as those described in U.S. Pat. Nos. 2,193,015 and 2,592,364; Japanese Patent Application (OPI) No. 64933/1973; and in L.F.A. Mason *Photographic Processing Chemistry*, pages 226–229, Focal Press, London (1966) can be used. Also 3-pyrazolidones can be used together with these developing agents.

The color developer solution can optionally contain various additives. Typical examples of such additives include alkali agents (for example, hydroxides, carbonates or phosphates of alkali metals or ammonia); pH-adjusting agents or buffers (for example, weak acids such as acetic acid, boric acid, etc. weak bases, or the salts thereof); development accelerators (for example, various pyridinium compounds or cationic compounds such as those described in U.S. Pat. Nos. 2,648,604 and 3,671,247; potassium nitrate; sodium nitrate; condensation products of polyethylene glycol, and their derivatives such as those described in U.S. Pat. Nos. 2,533,990; 2,577,127; and 2,950,970; nonionic compounds such as polythioethers represented by those described in British Patent Nos. 1,020,033 and 1,020,032; polymeric compounds having sulfite ester groups such as those described in U.S. Pat. No. 3,068,097; organic amines such as pyridine and ethanolamine; benzyl alcohol; hydrazines and the like); anti-fogging agents (for example, alkali metal bromides; alkali metal iodides; nitrobenzimidazoles such as those described in U.S. Pat. Nos. 2,496,940 and 2,656,271; mercaptobenzimidazole; 5-methylbenztriazole; 1-phenyl-5-mercaptotetrazole; compounds for use in rapid processing solutions such as those described in U.S. Pat. Nos. 3,113,864; 3,342,596; 3,295,976; 3,615,522 and 3,597,199; thiosulfonyl compounds such as those described in British Patent No. 972,211; phenazine-N-oxides such as those described in Japanese Patent Publication No. 41675/1971; those described in *Kagaku Shashin Binran (Manual of Scientific Photography)* vol. II, pages 29–47 and the like); stain or sludge preventing agents such as those described in U.S. Pat. Nos. 3,161,513 and 3,161,514 and British Pat. Nos. 1,030,422; 1,144,481 and 1,251,558; interlayer-effect accelerators disclosed in U.S. Pat. No. 3,536,487; preservatives (for example, sulfites, bisulfites, hydroxylamine, hydrochloride, formsulfite, alkanolamino-bisulfite adducts, etc.) and the like.

After color development, the light-sensitive material is subjected to a bleaching step in a conventional manner. The bleaching step can be combined with a fixing step. Many kinds of compounds are known as a bleaching agent. Of these compounds, ferricyanides, bichromates; water-soluble cobalt (III) salts, water-soluble copper (II) salts, water-soluble quinones; nitrosophenols; complex salts of a polyvalent cation such as iron (III), cobalt (III), copper (II) and an organic acid, for example, an aminopolycarboxylic acid such as ethylenediaminetetraacetic acid, nitrilotriacetic acid, iminodiacetic acid, N-hydroxyethylethylenediaminetriacetic acid, etc., malonic acid, tertaric acid, malic acid, diglycolic acid and dithioglycolic acid, and 2,6-dipicolinic acid; peracids such as alkylperacids, persulfates, permanganates and peroxides; hypochlorites; chlorine; bromine; and the like can be suitably used, individually or in combination. To the bleaching solution, bleaching accelerators such as those described in U.S. Pat. Nos. 3,042,520 and 3,241,966; and Japanese Patent Publication Nos. 8506/1970 and 8836/1970 and other various additives can be added.

The coupler of the invention can be applied for various purposes, for example, for uses to which conventional DIR couplers and interimage color correction couplers have been applied. Particularly, it can be applied to color negative light-sensitive materials, color positive light-sensitive materials, color photographic papers, reversal color light-sensitive materials and monochromatic color light-sensitive materials (e.g., color X-ray light-sensitive materials, color micrographic light-sensitive materials, color light-sensitive materials for forming drawings, etc.). Further, the coupler of this invention can be used for color direct positive light-sensitive materials and instant light-sensitive materials such as black and white diffusion transfer light-sensitive materials or color diffusion transfer light-sensitive materials.

The following examples are given to illustrate the present invention in greater detail.

EXAMPLE 1

A multi-layer color light-sensitive material (A) was prepared by coating Layers 1 to 8 as shown in FIG. 1 on a transparent cellulose triacetate film.

First Layer (antihalation layer)

A mixture of 1 g of 5% aqueous gelatin solution containing black colloidal silver and 1 g of the hardening agent as shown below was coated in a dry thickness of one micron.

Second Layer (intermediate layer)

In a mixture of 100 ml of tricresyl phosphate and 200 ml of ethyl acetate, 50 g of 2,5-di-tert-octylhydroquinone was dissolved. This solution was emulsified into a mixture of 1 kg of a 10% aqueous gelatin solution and 5 g of sodium dioctylsulfosuccinate by means of a high speed stirrer to provide Emulsion I. Then, 250 g of Emulsion I was mixed with 1 kg of a 10% aqueous gelatin solution and 1 g of the hardening agent was added to the mixture, and then the resulting mixture was coated in a dry thickness of one micron.

Third Layer (red-sensitive silver halide emulsion layer)

By adding $4 \times 10^{-5}$ mol of Spectral Sensitizer I and $1 \times 10^{-5}$ mol of Spectral Sensitizer II to 1 kg of a silver iodobromide emulsion (silver amount; 0.6 mol, iodide content; 7 mol%, average particle size; 0.5 micron), the silver iodobromide emulsion was spectrally sensitized. On the other hand, 95 g of Coupler I and Coupler (3) were dissolved in a mixture of 100 ml of tricresyl phosphate and 200 ml of ethyl acetate and then emulsified in the same manner as in the preparation of Emulsion I to provide Emulsion II.

To the silver iodobromide emulsion (1 kg), 450 g of Emulsion II and then 0.7 g of the hardening agent were added, and coated in a dry thickness of 4.5 microns.

Fourth Layer (intermediate layer)

Same as the second layer.

Fifth Layer (green-sensitive emulsion layer)

A silver iodobromide emulsion, the same as in the third layer, was spectrally sensitized by adding $2 \times 10^{-4}$ mol of Spectral Sensitizer III and $6 \times 10^{-5}$ mol of Spectral Sensitizer IV to 1 kg of the emulsion. To the emulsion, 600 g of Emulsion III was added which was prepared by dissolving 80 g of Coupler, II, 15 g of Coupler III and 5 g of Coupler (13) in a mixture of 100 ml of tricresyl phosphate and 200 ml of ethyl acetate and emulsifying it in the same manner as in the preparation of Emulsion I, and then 0.9 g of the hardening agent was added and coated in a dry thickness of 4 microns.

Sixth Layer (yellow filter layer)

To 200 g of Emulsion I, 1 kg of a 5% aqueous gelatin solution containing yellow colloidal silver and 1 g of the hardening agent were added, and then coated in a dry thickness of one micron.

Seventh Layer (blue-sensitive emulsion layer)

To 1 kg of silver iodobromide emulsion, the same as in the third layer, 4 g of Coupler (15) dissolved in 100 ml of dibutyl phthalate and 200 ml of ethyl acetate, and 500 g of Emulsion IV prepared in the same manner as in the preparation of Emulsion I, and then 1 g of the hardening agent were added, and the resulting mixture was coated in a dry thickness of 3 microns.

Eighth Layer (protective layer)

To 1 kg of a 10% aqueous gelatin solution, 1 g of the hardening agent was added and coated in a dry thickness of one micron.

The additives used for preparing Sample A are shown below:

HARDENING AGENT 2,6-Di-chloro-4-hydroxy-s-triazine sodium salt (2% aqueous solution)

COUPLER I

1-Hydroxy-N-[γ-(2),4-di-tert-amylphenoxypropyl)]-2-naphthamide

COUPLER II 1-(2,4,6-Trichlorophenyl)-3-[3-(2,4-di-tert-amylphenoxyacetamido)benzamido]-5-pyrazolone

COUPLER III 1-(2,4,6-Trichlorophenyl)-3-[(2-chloro-5-tridecanoylamino)-anilino]-4-(3-methyl-5-hydroxyphenylazo)-5-pyrazolone

COUPLER IV

α-(2,4-Di-oxo-5,5-dimethyloxazolidinyl)-α-pivaloyl-2-chloro-5-[α-(2,4-di-tert-amylphenoxy)butyramido]-acetoanilide

SPECTRAL SENSITIZER I

Anhydro-5,5'-dichloro-3,3'-disulfopropyl-9-ethylthiacarbocyanine hydroxide pyridinium salt

SPECTRAL SENSITIZER II

Anhydro-9-ethyl-3,3'-di-(3-sulfopropyl)-4,5,4',5'-dibenzothiacarbocyanine hydroxide triethylamine salt

SPECTRAL SENSITIZER III

Anhydro-9'-ethyl-5,5'-dichloro-3,3'-disulfopropyloxacarbocyanine sodium salt

SPECTRAL SENSITIZER IV

Anhydro-5,6,5',6'-tetrachloro-1,1'-diethyl-3,3'-disulfopropoxethoxyethylimidazolocarbocyanine hydroxide sodium salt For comparison, Sample B and Sample C were prepared as follows.

Sample B

The same procedure as in the preparation of Sample A was repeated except that Coupler α instead of Coupler (3) in the third layer, Coupler β instead of Coupler (13) in the fifth layer, and Coupler γ instead of Coupler (15) in the seventh layer were employed.

COUPLER α

1-Hydroxy-4-(1-phenyltetrazolylthio)-(2-tetradecyloxy)-α-naphthanilide

COUPLER β

1-{4-[α-(2,4-di-tert-amylphenoxy)butyramido]-phenyl}-3-dibutylamino-4-(1-phenyltetrazolylthio)-5-pyrazolone

COUPLER γ

α-pivaloyl-α-(1-phenyltetrazolylthio)-2-chloro-5-α-(2,4-di-tert-amylphenoxybutyramido)acetanilide Sample C The same procedure as in the preparation of Sample A was repeated except that 100 g of Coupler I was employed instead of 95 g of Coupler I and 5 g of Coupler (3) in the third layer, 84 g of Coupler II, and 16 g of Coupler III were employed instead of 80 g of Coupler II, 15 g of Coupler III and 5 g of Coupler (13) in the fifth layer and 100 g of Coupler IV was employed instead of 96 g of Coupler IV and 4 g of Coupler (15) in the seventh layer.

Samples A, B and C were exposed in a camera as 16 mm color negative films, and then developed at 38° C using the following processing steps.

| | |
|---|---|
| 1. Color Development | 3 min. 15 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The processing compositions used for each processing step are shown below.

| Color Developing Solution | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxyamine Sulfate | 2.4 g |
| 4-(N-Ethyl-N-beta-hydroxyethylamino)-2-methyl-aniline Sulfate | 4.5 g |
| Water to make | 1 liter |

| Bleaching Solution | |
|---|---|
| Ammonium Bromide | 160.0 g |
| Ammonia (28% aq. soln.) | 25.0 ml |
| Fe(III)-Ethylenediamine Tetraacetic Acid (sodium salt) | 130.0 g |
| Glacial Acetic Acid | 14.0 ml |
| Water to make | 1 liter |

| Fixing Solution | |
|---|---|
| Sodium Tetrapolyphosphate | 2.0 g |
| Sodium Sulfite | 4.0 g |
| Ammonium Thiosulfate (70% aq. soln.) | 175.0 ml |
| Sodium Bisulfite | 4.6 g |

-continued

| Fixing Solution | |
|---|---|
| Water to make | 1 liter |

| Stabilizing Solution | |
|---|---|
| Formalin (40% aq. soln) | 8.0 ml |
| Water to make | 1 liter |

The color negative images obtained from Sample B containing the conventional DIR coupler were superior in sharpness and granularity to those obtained from Sample C, but the purity of the color images of Sample B was not improved. On the contrary, the color negative images obtained from Sample A were superior in sharpness and granularity to those obtained from Sample B, and the purity of the color images was remarkably improved.

On the other hand, Samples A, B and C were allowed to stand for 3 days in the dark at 60% relative humidity for an incubation test, and then processed as described above. The color negative images obtained from Samples A and C were hardly deteriorated in comparison with the color images obtained without the incubation test. The color density of the color negative images obtained from Sample B containing the conventional DIR coupler was reduced in comparison with that of the color images obtained without the incubation test, and particularly, the color density in the magenta and cyan color images was remarkably reduced. The disadvantage occurs due to the fact that the DIR coupler included in Sample B reduces the sensitivity of the photographic emulsion layer.

From the above results, it is concluded that light-sensitive material Sample A containing the coupler of the invention is superior in image properties and stabilization for storability than the light-sensitive material Sample B containing the conventional DIR coupler.

EXAMPLE 2

A multi-layer color light-sensitive material Sample D having the layers as shown in FIG. 2 was prepared according to Example 1. The coating composition for each layer was as follows:

First Layer (antihalation layer)

Same as the first layer of Sample A in Example 1.

Second Layer (intermediate layer)

Same as the second layer of Sample A in Example 1.

Third Layer (first red-sensitive emulsion layer; dry coating thickness: 2 microns)

Silver iodobromide emulsion: silver coating amount: 1.2 g/m$^2$
silver amount: 0.05 mol%
iodine content: 7 mol%
average particle size: 0.4 micron
gelatin: 6.2%

| | |
|---|---|
| Spectral Sensitizer I | $5 \times 10^{-5}$ mol per mol of silver |
| Spectral Sensitizer II | $1.2 \times 10^{-5}$ mol per mol of silver |
| Coupler I | 0.09 mol per mol of silver |
| Coupler V | 0.02 mol per mol of silver |
| Coupler (17) | 0.005 mol per mol of silver |
| Coupler VI | 0.01 mol per mol of silver |
| Hydroquinone Derivative I | 0.15 mol per mol of silver |
| Hardening Agent | 20 mg/m$^2$ |

Fourth Layer (second red-sensitive emulsion layer; dry coating thickness: 1.5 microns):

Silver iodobromide emulsion: Silver coating amount: 1.0 g/m$^2$
silver amount: 0.048 mol%
iodine content: 8 mol%
average particle size: 0.7 micron
gelatin: 6.4%

| | |
|---|---|
| Spectral Sensitizer I | $3 \times 10^{-5}$ mol per mol of silver |
| Spectral Sensitizer II | $1.2 \times 10^{-5}$ mol per mol of silver |
| Coupler I | 0.05 mol per mol of silver |
| Coupler V | 0.04 mol per mol of silver |
| Coupler (17) | 0.001 mol per mol of silver |
| Coupler VI | 0.01 mol per mol of silver |
| Hardening Agent | 15 mg/m$^2$ |

Fifth Layer (intermediate layer)

Same as the second layer in Sample A in Example 1.

Sixth Layer (first green-sensitive emulsion layer; dry coating thickness: 2.4 microns)

Silver iodobromide emulsion: silver coating amount: 1.4 g/m$^2$ (same as the third layer)

| | |
|---|---|
| Spectral Sensitizer III | $3 \times 10^{-5}$ mol per mol of silver |
| Spectral Sensitizer VI | $1 \times 10^{-5}$ mol per mol of silver |
| Coupler II | 0.05 mol per mol of silver |
| Coupler III | 0.01 mol per mol of silver |
| Coupler (11) | 0.003 mol per mol of silver |
| Coupler VII | 0.005 mol per mol of silver |
| Hydroquinone Derivative II | 0.004 mol per mol of silver |
| Hardening Agent | 25 mg/m$^2$ |

Seventh Layer (second green-sensitive emulsion layer; dry coating thickness: 1.6 micron)

Silver iodobromide emulsion: silver coating amount: 2.0 g/m$^2$ (same as the fourth layer)

| | |
|---|---|
| Spectral Sensitizer III | $2.4 \times 10^{-5}$ mol per mol of silver |
| Spectral Sensitizer IV | $0.8 \times 10^{-5}$ mol per mol of silver |
| Coupler II | 0.005 mol per mol of silver |
| Coupler III | 0.015 mol per mol of silver |
| Coupler (11) | 0.0002 mol per mol of silver |
| Coupler VII | 0.001 mol per mol of silver |
| Hardening Agent | 20 mg/m$^2$ |

Eighth Layer (yellow filter layer)

Same as the sixth layer of Sample A in Example 1.

Ninth Layer (first blue-sensitive emulsion layer; dry coating thickness: 2 microns)

Silver iodobromide emulsion: silver coating amount: 1.3 g/m$^2$
silver amount: 0.047 mol%
iodine content: 7.5 mol%
average particle size: 0.5 micron
gelatin: 0.2%

| | |
|---|---|
| Coupler IV | 0.23 mol per mol of silver |
| Coupler (15) | 0.01 mol per mol of silver |

-continued

| | |
|---|---|
| Hardening Agent | 20 mg/m² |

Tenth Layer (second blue-sensitive emulsion layer; dry coating thickness: 1.2 microns)

Silver iodobromide emulsion: silver coating amount: 1.2 g/m²
silver amount: 0.052 mol%
iodine content: 6 mol%
average particle size: 0.7 micron
gelatin: 6%

| | |
|---|---|
| Coupler IV | 0.06 mol per mol of silver |
| Hardening Agent | 8 mg/m² |

Eleventh Layer (protective layer)

Same as the eighth layer of Sample A in Example 1.

In the additives employed for preparing the Sample D, Couplers I to IV, spectral Sensitizers I to IV and the Hardening Agent were same as those in Sample A, and the other components are shown below:

COUPLER V

1-Hydroxy-4-(2-ethyloxycarbonylphenylazo)-N-(2-ethylamyl)-2-naphthamide

COUPLER VI

α-(4-Octadecyloxybenzoyl)-α-(5- or 6-bromo-1-benzotriazole)-α-methoxyacetoanilide

COUPLER VII 1-(4-Butylaminophenyl)-3-(2-methoxy-5-tetradecyloxycarbonylanilino)-4-(5- or 6-bromo-1-benzotriazolyl)-5-pyrazolone

HYDROQUINONE DERIVATIVE I

4'-thiaziazol-5'-ylthio)-6-n-pentadecylhydroquinone

Hydroquinone Derivative II:

2-n-Hexadecylthio-5-(1'-ylthio)-6-phenylthiohydroquinone

Sample D was cut to prepare a 35 mm cinema color negative light-sensitive material, was exposed in a cinema camera and then was developed using the following color development processing steps.

| Processing Step | Temperature | Time |
|---|---|---|
| Color Development | 38° C | 3 min. |
| Stop | " | 1 min. |
| Wash | " | 1 min. |
| Bleach | " | 2 min. |
| Wash | " | 1 min. |
| Fix | " | 2 min. |
| Wash | " | 1 min. |
| Stabilizing Bath | " | 1 min. |

The compositions of the processing solutions for each of the processing steps are shown below:

| Color Developing Solution | |
|---|---|
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Disodium Ethylenediamine | |

-continued

| Color Developing Solution | |
|---|---|
| Tetraacetate (dihydrate) | 2 g |
| 4-Amino-3-methyl-N-ethyl-N-(beta-hydroxyethyl)aniline Monosulfate | 4 g |
| Water to make | 1 liter |

| Stopping Solution | |
|---|---|
| Sodium Thiosulfate | 10 g |
| Ammonium Thiosulfate (70% aq. soln.) | 30 ml |
| Acetic Acid | 30 ml |
| Sodium Acetate | 5 g |
| Potassium Alum | 15 g |
| Water to make | 1 liter |

| Bleaching Solution | |
|---|---|
| Fe(III)-Disodium Ethylenediamine Tetraacetate (dihydrate) | 100 g |
| Potassium Bromide | 50 g |
| Ammonium Nitrate | 50 g |
| Borax | 5 g |
| Aqueous Ammonia | amount necessary for adjusting pH to 5.0 |
| Water to make | 1 liter |

| Fixing Solution | |
|---|---|
| Sodium Thiosulfate | 150 g |
| Sodium Sulfite | 15 g |
| Borax | 12 g |
| Glacial Acetic Acid | 15 g |
| Potassium Alum | 20 g |
| Water to make | 1 liter |

| Stabilizing Bath | |
|---|---|
| Borax | 5 g |
| Sodium Citrate | 5 g |
| Sodium Metaborate (tetrahydrate) | 3 g |
| Potassium Alum | 15 g |
| Water to make | 1 liter |

As the result of the above Example, color negative images for cinema obtained from Sample D containing Couplers (11) and (17) of the invention, the inter-image color correction Couplers VI and VII as disclosed in Japanese Patent Application No. 33,238/73, and Hydroquinone Derivatives I and II as disclosed in Japanese Patent Application No. 41,870/73 were excellent in color purity, granularity and sharpness.

In Example 2, the same excellent results were obtained by replacing Coupler (17) in the third and fourth layers with Coupler (1), (2), (3), (5), (7), (9), (12), (17) and a mixture thereof. Further, the same results were obtained by replacing Coupler (11) in the sixth and seventh layers with Couplers (13), (14) and a mixture thereof, and by replacing Coupler (15) in the ninth layer with Coupler (16).

As is apparent from the above, the photographic light-sensitive material of the invention has excellent image granularity, image sharpness and stability for storage, and particularly, has improved color purity, color reproducing properties and light-fastness of the color images where the photographic material is used for color uses.

While the invention has been described in detail and with reference to specific embodiments thereof, it will be apparent to one skilled in the art that various changes and modifications can be made therein without departing from the spirit and scope thereof.

What is claimed is:

1. In a light-sensitive silver halide photographic material comprising a support and at least one silver halide emulsion layer the improvement which comprises at least one hydrophilic colloid layer which contains a color-forming coupler represented by the formula (I)

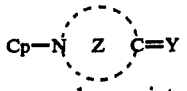

(I)

wherein Cp is a coupler moiety capable of coupling with an oxidation product of a color developing agent; Y is sulfur, selenium or tellurium; and Z is a nitrogen-containing moiety, which is incapable of exhibiting tautomerism prior to release from the coupler moiety and is released on coupling with the oxidation product of the color developing agent and a nitrogen atom of which is bonded to the coupling position of the Cp moiety, said nitrogen atom also being bonded to the C=Y moiety by a single bond.

2. The photographic material as claimed in claim 1, wherein said coupler is represented by the formulae (II), (III) and (IV)

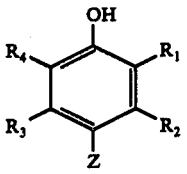

(II)

wherein $R_1$ and $R_2$ each is an alkyl group, an aryl group, a heterocyclic group, a hydrogen atom, a halogen atom, an amino group, a carbonamido group, a sulfonamido group, a sulfamoyl group, a carbamoyl group or an alkoxy group; $R_3$ and $R_4$ each is as defined for $R_1$ and $R_2$ and can represent an atomic group necessary for completing a benzo group together; and Z is the nitrogen-containing heterocyclic group releasable on coupling of formula (I);

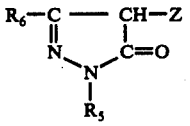

(III)

wherein $R_5$ is an alkyl group, an aryl group, or a heterocyclic group, $R_6$ is an alkyl group, an amino group, an alkoxycarbonyl group, an aryl group, a heterocyclic group or an alkoxy group; and Z is the nitrogen-containing heterocyclic group releasable on coupling of formula (I);

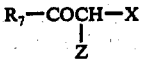

(IV)

wherein $R_7$ is an aliphatic hydrocarbon group or an aryl group; X is a cyano group or a carbamoyl group; and Z is the nitrogen-containing heterocyclic group releasable on coupling of formula (I).

3. The photographic material as claimed in claim 1, wherein said coupler and at least one other two or four equivalent coupler are incorporated in the same hydrophilic colloid layer.

4. The photographic material as claimed in claim 1, wherein Y is sulfur.

5. The photographic material as claimed in claim 1, wherein Y is selenium.

6. The photographic material as claimed in claim 1, wherein Y is tellurium.

* * * * *